United States Patent [19]

Casella

[11] 4,005,336

[45] Jan. 25, 1977

[54] HIGH INTENSITY DISCHARGE LAMP STARTING CIRCUIT

[75] Inventor: Daniel C. Casella, South Hamilton, Mass.

[73] Assignee: GTE Sylvania Incorporated, Danvers, Mass.

[22] Filed: Jan. 3, 1975

[21] Appl. No.: 538,349

[52] U.S. Cl. ..... 315/239; 315/240; 315/243; 315/245; 315/289; 315/DIG. 5

[51] Int. Cl.[2] ..... H05B 41/18

[58] Field of Search ..... 315/242, 243, 244, 283, 315/DIG. 2, DIG. 5, DIG. 7, 239, 240, 245, 289

[56] References Cited

UNITED STATES PATENTS

| | | | |
|---|---|---|---|
| 2,963,623 | 12/1960 | Cornell | 315/DIG. 2 |
| 3,235,770 | 2/1966 | Wattenbach | 315/243 X |
| 3,353,062 | 11/1967 | Nuckolls | 315/243 X |
| 3,407,334 | 10/1968 | Attewell | 315/DIG. 5 |
| 3,917,976 | 11/1975 | Nuckolls | 315/240 X |

FOREIGN PATENTS OR APPLICATIONS

| | | | |
|---|---|---|---|
| 1,019,066 | 2/1966 | United Kingdom | 315/DIG. 5 |

*Primary Examiner*—Siegfried H. Grimm
*Attorney, Agent, or Firm*—James H. Grover

[57] ABSTRACT

A starting circuit for high intensity discharge lamps supplied from an alternating current line through a ballast inductance, and in some cases a pulse transformer inductance, includes a surge voltage protector (SVP) or like voltage responsive, current switching gas breakdown device connected intermediate the end of the inductance, a capacitor connected to the lamp end of the inductance, the SVP and capacitor being connected in parallel with each other and in series with a resistance across the lamp so that upon breakdown of the device in each half AC cycle the capacitor discharges applying a voltage surge to the lamp stepped up through the inductance. The charge on the capacitor follows the ignition voltage required to start or reignite the lamp as the ignition voltage varies during the life of the lamp.

2 Claims, 6 Drawing Figures

HIGH INTENSITY DISCHARGE LAMP STARTING CIRCUIT

BACKGROUND OF THE INVENTION

Relatively low intensity mercury lamps, long used for outdoor as well as indoor lighting, require a relatively simple ballast inductance and power factor capacitor (PFC) for starting and running the lamp, reigniting it each half cycle of applied alternating current. There are millions of such simple ballast installations in the United States which are inadequate to start and run high intensity discharge (HID) lamps which have greatly improved light intensity and color.

High intensity discharge lamps include, for example, high pressure mercury lamps, high pressure sodium (HPS) lamps, metal halide and other halide lamps. All these HID lamps are difficult or impossible to start and run with the widely installed simple ballast, and many complex starting circuits have been proposed to replace the existing installations. Examples are found in U.S. Pat. Nos. 3,235,769 and 3,235,770, 3,334,270 and 3,383,558. Such prior starting circuits are typically designed for one type of HID lamp and do not work with other lamps.

It is the object of the present invention to provide a decidedly simpler starting circuit with fewer, more reliable components, which can be used in replacement or modification of existing ballast installations, which is effective to start all types of low and high intensity discharge lamps, and which responds to changes in the ignition (cold starting and reignition) voltage requirements of individual lamps, as this voltage varies during and beyond the normal or nominal life of the lamp.

SUMMARY OF THE INVENTION

According to the invention a starting circuit for a high intensity discharge lamp comprises alternating current line terminals, lamp terminals having connections to the line terminals, at least one connection including an inductance, a voltage responsive, bidirectional, current switching breakdown device connected to the inductance intermediate its ends, a capacitor connected to an end of the inductance remote from one line terminal, and a resistance connected to the other lamp terminal, the breakdown device and capacitor being connected in parallel with each other and in series with the resistance across the lamp, the capacitor discharging a current surge through the inductance upon breakdown of the device as the line voltage approaches maximum so as to apply an ignition pulse to start discharge through the lamp, and the device being responsive to increase in lamp ignition voltage with age to provide an increased ignition pulse voltage.

Further according to the invention the breakdown device comprises a gas filled, arc discharge valve having a switching time characteristic of a small fraction of a microsecond. Further the valve has negligible impedance during arc discharge.

DRAWINGS

DESCRIPTION

Figure 1:
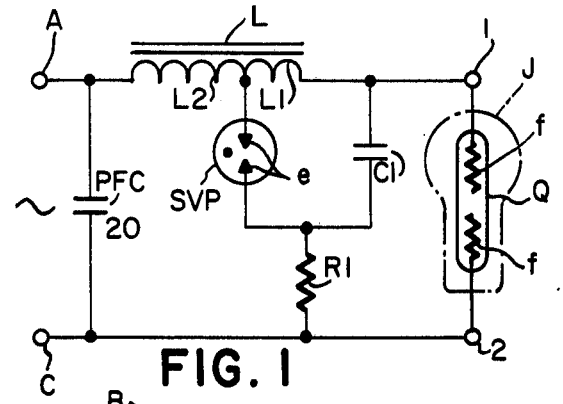
FIG. 1 is a schematic diagram of an HID lamp ballast and starting circuit according to the invention.
Figure 2:
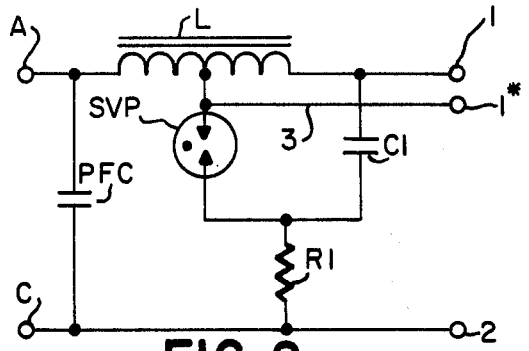
FIG. 2 is a modified form of the circuit of FIG. 1.
Figure 3:
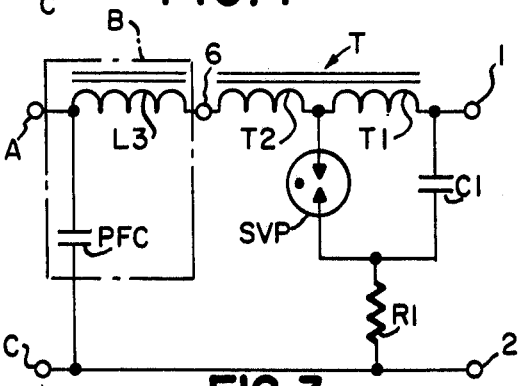
FIGS. 3 to 5 show modifications of an existing ballast by addition of a pulse transformer.
Figure 4:
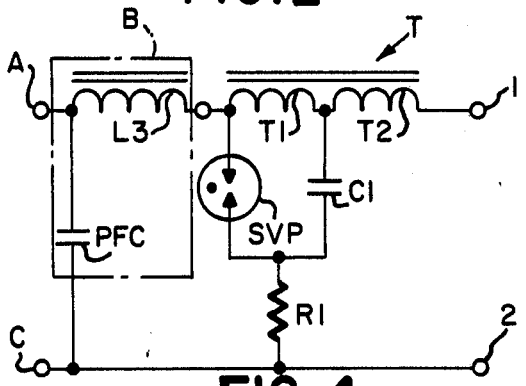
Figure 5:
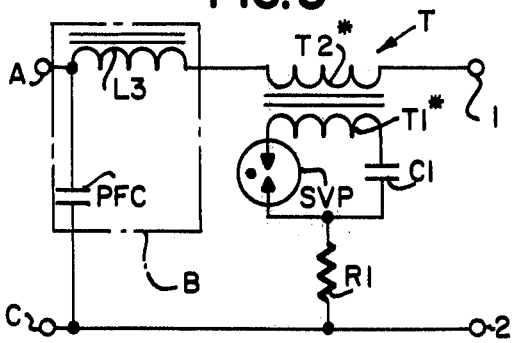

Shown schematically in FIG. 1 is a HID lamp, typically for 175 or 400 watts operation, having an outer jacket J, sometimes phosphor coated on its inner wall, and an inner quartz arc tube Q enclosing electrodes *f*. Carried outside the jacket J are lamp terminals 1 and 2. Connected between one 240 volt alternating current line terminal A and a lamp terminal 1 is a ballast inductance L. The other line terminal C is connected to another lamp terminal 2, and a power factor capacitor PFC is connected across the line terminals. The ballast circuit so far described is adequate to start and run the early mercury lamps, and several million such basic ballast circuits are installed throughout the United States. The basic ballast is, however, inadequate reliably to start and run more recent HID lamps such as high pressure sodium lamps, metal halide and other halide lamps. According to the present invention all these lamps can be reliably started and operated for a time extended beyond the normally expected life by a modified ballast as shown in FIGS. 1 and 2, or by external modification of existing basic ballasts as shown in FIGS. 3 to 5.

In FIG. 1 a surge voltage protector SVP is connected to a tap on the ballast inductance L, dividing the ballast into a secondary winding L2 and a primary winding L1 having a turns ratio of approximately 6½ to 1. A suitable ballast for a 400 watt HID lamp is Sylvania HPF Reactor No. F09-91395-1362 which includes a 19.8, 300 volt AC power factor capacitor PFC, Sprague No. 232-P-199.

The surge voltage protector SVP comprises a glass or ceramic envelope mounting two arc electrodes *e* and a fill of inert gas, the electrode spacing and gas pressure being chosen to allow breakdown and conduction of the SVP at a selected applied voltage. A suitable SVP is Siemens type A1-A230 having a breakdown voltage of 230 volts ± 15 volts. Other SVP's with a breakdown in the range of 90 to 1000 volts may be used. When the breakdown voltage is applied across its electrodes the SVP changes from a non-conducting to a conducting state with substantially negligible power loss within a small fraction of a microsecond (as compared to the several microsecond interval for change of state of a semiconductor switch, or milliseconds for magnetic devices. Whereas the SVP is a voltage responsive device it switches high currents at a very high rate ($di/dt$). The SVP has a life comparable to such other switching devices and a particular advantage in the present circuit.

Connected in parallel with the SVP at the end of the ballast remote from the line terminal A is a one microfarad starting capacitor C1 rated in excess of the SVP breakdown voltage, for example 600 watt-volts DC. A suitable capacitor is an Aerovox type P-82-92ZN-31 metallized paper, tubular capacitor. The parallel SVP and starting capacitor C1 are connected in series with a 50 watt resistor, typically 1000 ohms to the other line terminal C.

In the lamp circuit of FIG. 1 alternating current line voltage is applied to the lamp through the reactor ballast L which, is a well known manner, causes a small reactive voltage maximum in the line voltage early in each half lamp voltage cycle, the maximum being in the order of 277 volts, which may or may not be sufficient to ignite a cold lamp or to reignite the lamp each half cycle thereafter.

As shown in FIG. 2, which is otherwise identical with FIG. 1, a lead wire 3 to an auxiliary lamp terminal 1* may be connected to the SVP tap on the ballast to provide 240 volt operating supply for a lamp as compared with the 277 volt supply at lamp terminal 2. For reliable starting and operation of HID lamps there is required a higher peak ignition pulse, by which it is meant to include both initial ignition pulses for a cold lamp and subsequent reignition pulses. While auxiliary circuits are known which provide high voltage ignition pulses superimposed on the ballast voltage, the present starting circuit (SVP, C1, R1) does so far more reliably with all known types of HID lamps, utilizing uncomplicated circuitry and inexpensive, reliable components, and operating in a new mode by responding instantaneously to lamp voltage, so as to prolong the useful life of the lamp substantially.

When the lamp is started cold its impedance is very high and the voltage from the ballast builds up each half AC cycle across the lamp charging the starting capacitor C1. The RC time constant of resistor R1 and capacitor C1 being very small (1 millisecond), the capacitor charge follows the lamp voltage very closely. When the capacitor charge voltage exceeds the breakdown voltage of the SVP, the voltage responsive SVP instantly fires, conducting with negligible impedance, and the capacitor discharges through the primary L1 of the tapped ballast L. The discharge voltage is stepped up, 6 to 10 times typically, by the secondary L2 of the ballast, producing one or more high voltage ignition pulses or spikes in the order of 1 to 2 kilovolts which are more than adequate to strike an arc across the lamp and draw operating voltage through the ballast. The pulses or spikes will occur in the first quarter cycle or 90° as the AC voltage approaches or reaches maximum. The ignition pulses have a rise time of approximately 1 microsecond or less, are 20 to 25 microseconds in duration, and are spaced approximately 1.3 milliseconds apart. The number of pulses each half cycle can be varied by increasing or decreasing the breakdown voltage of the SVP, capacitance C1 or the line voltage. Pulse width can be increased by increasing capacitance C1. The pulsing results from interaction between capacitor C1 and the ballast L, but it is the ability of the SVP to switch the discharge current on and off rapidly owing to its high *di/dt* characteristic which allows high pulse peak voltage and multiple pulsing and assures ignition of the HID lamp and prevents hang-up of the lamp in its starting glow periods. It is believed that the first one or two pulses clean contamination from the lamp electrodes *f* and that one or more immediately succeeding pulses strike an arc before the electrodes become recontaminated.

Figure 6:
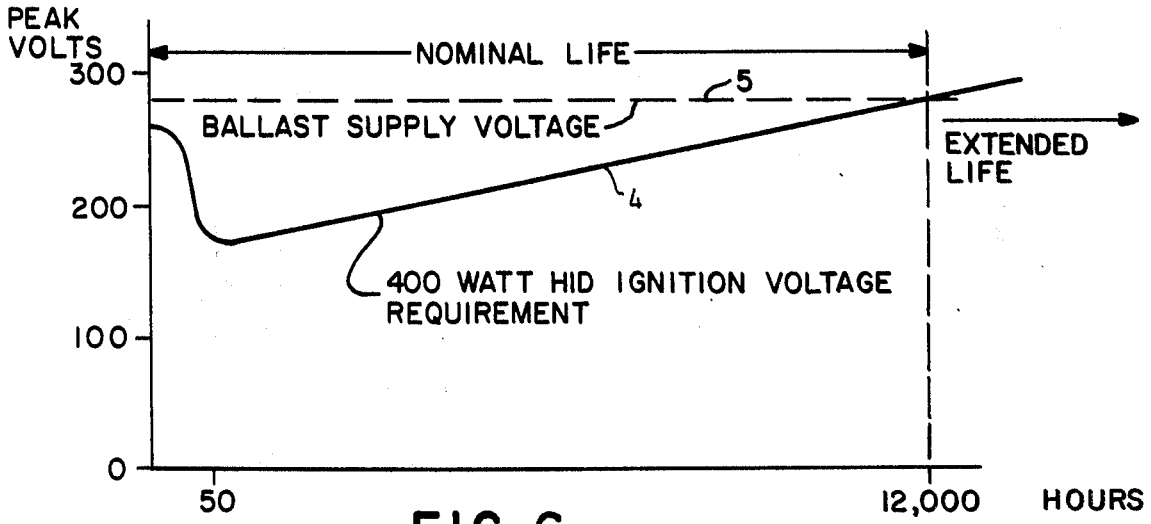
FIG. 6 is a graph of HID lamp peak reignition voltage versus hours of lamp life.

FIG. 6 illustrates the change of HID lamp reignition voltage during its nominal life and beyond. A new lamp typically will require between 250 and 300 volts peak voltage to ignite (or reignite). In its first 50 hours of operation this voltage requirement (curve 4) drops to about 175 volts peak and then climbs slowly, while the voltage supplied by the ballast (curve 5) remains fairly constant near 300 volts. Ultimately (12,000 hours is an excellent life expectancy) the lamp ignition requirement 4 will exceed the available supply 5 and the lamp will fail with prior starting circuits producing ignition pulses of fixed amplitude. With the present starting circuit, however, when, at the time of extinction or near extinction each half cycle, the lamp voltage becomes higher with age, so also will the charge voltage across the capacitor. Because the starting capacitor is connected at the end of the ballast remote from line terminal A and in FIGS. 1 and 2 directly across the lamp, the starting capacitor charge voltage follows the lamp voltage, it will discharge at a higher voltage late in lamp life. Consequently the ignition pulses applied on each half cycle discharge of capacitor C1 will follow the higher ignition (or reignition) voltage requirement of the lamp and will continue to operate the lamp after the lamp requirement has exceeded the supply voltage. In contrast with prior ballasts the present ballast will thus operate HID lamps substantially beyond their normal life with prior ballasts.

While FIGS. 1 and 2 show a complete ballast including reactor L1, power factor capacitor PFC and starting circuit SVP, C1 and R1 suitable for potting in a closed unit, FIGS. 3 to 5 show how the present starting circuit can be used in modification of the standard ballast B now in millions of installations. The standard ballast B typically includes an untapped inductance L3 and power factor capacitor PFC potted in an enclosure with only alternating current input leads A and C and an output lead 6.

The circuit of FIG. 3 includes an autotransformer T with a secondary winding T2 connectable to the existing ballast output 6 and a primary winding T1 connected to lamp terminal 1, the resistor R1 of the starting circuit being connected to the common AC line terminal C and lamp terminal 2 as in FIGS. 1 and 2. Also as in the previously described circuits the starting capacitor C1 follows the lamp voltage, the primary T1 having negligible impedance compared to the ballast impedance L. On breakdown of the SVP the capacitor C1 discharges through the primary T1, and discharge voltage being stepped up 6 to 10 times by the corresponding T2:T1 turns ratio, to provide one or more 1 to 2 kilovolt pulses to the lamp.

In FIG. 4 the starting circuit is connected across the autotransformer primary T1 adjacent the ballast inductance L, but the operation is the same as described with respect to FIG. 3, and in both cases the starting capacitor C1 can be connected to the end of the inductance L remote from the AC line, owing to the negligible inductance of the pulse transformer windings T1 and T2.

In FIG. 5 the pulse transformer T* primary windings T1* and T2* are on a common core, the connections to the ballast being similar to those in FIGS. 3 and 4 and the operation being the same.

It should be understood that the present disclosure is for the purpose of illustration only and that this invention includes all modifications and equivalents which fall within the scope of the appended claims.

I claim:

1. A starting circuit for a high intensity discharge lamp comprising:

alternating current line terminals, lamp terminals having connections to the line terminals, at least one connection including an inductance, a voltage responsive current switching surge voltage protector breakdown device connected to the inductance intermediate its ends, said device having a switching time in the order of a microsecond, a capacitor and the breakdown device connected to each other through a portion of the inductance, and a resistance in series with the capacitor across the lamp terminals, wherein the inductance includes an inductive reactor and at least one winding of a pulse transformer connected between the reactor and one lamp terminal.

2. Apparatus according to claim 1 wherein the inductive reactor is sealed in a closed housing and the pulse transformer winding is connected in series therewith externally of the housing.

* * * * *